US005960510A

United States Patent [19]

James et al.

[11] Patent Number: 5,960,510

[45] Date of Patent: Oct. 5, 1999

[54] APPARATUS FOR HAIR BRUSH HAIR REMOVAL

[76] Inventors: Joshua James; Cherie James, both of 387 W. 500 S., Apt. #1, Orem, Utah 84058

[21] Appl. No.: 08/780,392

[22] Filed: Jan. 8, 1997

[51] Int. Cl.[6] ..... A46B 17/06

[52] U.S. Cl. ..... 15/246; 15/159.1; 132/119

[58] Field of Search ..... 132/119, 120; 15/247, 246, 160, 159.1, 257.01, 169, 175, 184; 119/628

[56] References Cited

U.S. PATENT DOCUMENTS

| | | | |
|---|---|---|---|
| 807,127 | 12/1905 | Powers | 132/119 |
| 1,059,282 | 4/1913 | De Bassini | 132/119 |
| 1,249,334 | 9/1916 | Colchin | 132/119 |
| 1,290,554 | 1/1919 | Healey | 15/246 |
| 1,789,526 | 1/1931 | Hutchings | 132/119 |
| 1,794,754 | 3/1931 | Burkhart | 132/119 |
| 2,437,298 | 3/1948 | Heyman | 132/119 |
| 2,529,927 | 11/1950 | Fisk | 15/169 |
| 2,553,242 | 5/1951 | Dombitsky | 132/119 |
| 2,865,039 | 12/1958 | Kaye et al. | 15/184 |
| 3,108,305 | 10/1963 | Peilet | 15/169 |
| 3,110,053 | 11/1963 | Surabian | 15/169 |
| 3,172,139 | 3/1965 | Wire | 15/160 |
| 3,470,575 | 10/1969 | Larson et al. | 15/38 |
| 3,577,580 | 5/1971 | Rand | 15/169 |
| 3,590,413 | 7/1971 | Colson, Jr. | 15/38 |
| 3,737,936 | 6/1973 | Uosaki | 15/169 |
| 3,805,318 | 4/1974 | Marquette | 15/38 |
| 3,886,617 | 6/1975 | Labran et al. | 15/169 |
| 3,982,296 | 9/1976 | Russo | 15/38 |
| 4,084,282 | 4/1978 | Calvert | 15/38 |
| 4,147,174 | 4/1979 | Peilet | 132/119 |
| 4,225,997 | 10/1980 | Thomas et al. | 15/184 |
| 4,308,634 | 1/1982 | Eisenberg | 15/142 |
| 4,479,279 | 10/1984 | Schroeder | 15/246 |
| 4,517,703 | 5/1985 | Koke | 15/246 |
| 4,574,416 | 3/1986 | Stewart et al. | 15/169 |
| 5,205,011 | 4/1993 | Flener | 15/142 |
| 5,267,528 | 12/1993 | Murieen, Sr. | 119/88 |
| 5,519,912 | 5/1996 | Kowamura | 15/246 |
| 5,600,865 | 2/1997 | Morrison | 15/160 |

FOREIGN PATENT DOCUMENTS

| | | | |
|---|---|---|---|
| 448955 | 6/1936 | United Kingdom | 15/247 |
| 685956 | 1/1953 | United Kingdom . | |

*Primary Examiner*—Gary K. Graham

*Attorney, Agent, or Firm*—Thorpe, North & Western, LLP

[57] ABSTRACT

A hair brush hair removal system which in a preferred embodiment includes a hair brush attachment composed of numerous strands of a flexible and elastic material which is placed around a brush core. Various fastening means enable the attachment to be tightly wrapped and fastened around a core. When removed from the core, the strands bring with them the hair which has accumulated on the bristles. Hair is then easily removed from the strands, and then the attachment is again wrapped around the core.

3 Claims, 5 Drawing Sheets

APPARATUS FOR HAIR BRUSH HAIR REMOVAL

BACKGROUND OF THE INVENTION

1. Field of the Invention

This invention pertains to a hair brush accessory. More specifically, the invention is comprised of an attachment for use with a variety of hair brush designs having different core and handle configurations, the attachment having a form suitable for attachment to the core of the particular brush on which it is disposed. The attachment is disposed over the bristles before using the brush so that hair which becomes entangled in the bristles can be removed by removing the attachment.

2. State of the Art

A hair brush has the annoying drawback of accumulating the hair it is designed to brush. This problem is as unavoidable as it is messy. Therefore, many brushes have been designed to overcome the problem of hair removal. A perusal of the prior art is instructive, however, in that it shows the general thinking of those skilled in the art as to how the problem must be solved.

G.B. Patent No. 685,956 issued to Saltzinger teaches a wire brush which has a plurality of bristle guides to maintain the wire bristles in an upright position. The bristle guides are holes in a plate, wherein the plate is an unremovable attachment. The plate is permitted to slide forward from the core surface at the base of the bristles until almost reaching the bristle tips. Hair is then removed from the bristles assuming that it is now easier to reach the hair because it has been forced to the bristle tips. Saltzinger is important not just because it is such an early design, but because it seems to have set the tone for almost every patent which followed.

U.S. Pat. No. 2,529,927 issued to Fisk apparently teaches a hairbrush with a slidable bristle cleaning plate which is attached to the face of the brush, similar to the arrangement of Saltzinger. The plate does not appear to be detachable from the brush. Like Saltzinger, the attachment appears to be custom designed to fit only the brush disclosed because of the unique attaching mechanism.

U.S. Pat. No. 2,553,242, issued to Dombitsky apparently teaches an attachment for cleaning brushes and combs. The attachment appears to be a disposable backing which must be formed of a mesh-like material which is capable of being pierced by the brush bristles or comb teeth. In a preferred embodiment, the attachment is a hollow, sock-like member which is inserted over the brush bristles and the bristles are then forced through the mesh. The attachment is then completely removed from the brush and disposed with the hair. Unlike the previous patents, Dombitsky is removable from the hair brush.

U.S. Pat. No. 3,108,305 issued to Peilet apparently teaches a brush having a bristle guide plate similar to Saltzinger and Fisk. The guide plate rests against the core surface until it is extended out from the core along the length of the bristles so that hair can be removed therefrom.

U.S. Pat. No. 3,110,305 issued to Surabian apparently teaches a hairbrush having a plate through which the bristles pass to push hair toward the bristle tips. Any novelty must be in the plate which appears to be recessed within the brush core.

U.S. Pat. No. 3,172,139 issued to Wire apparently teaches a brush with a cleaning plate with a different twist on the design of a non-removable plate. The cleaning plate comprises a bar attached at approximately a midpoint of the brush between the core and brush handle. Pivoting the plate forces hair from the bristles as the plate moves away from the brush face. A difference between the prior art already described is that the plate is not tight around the bristles, and actually does not appear to touch them. This probably limits the effectiveness of removing hair which is tightly entwined within the bristles.

U.S. Pat. No. 2,577,580 issued to Rand teaches two U-shaped clip members which pass through the back of the brush. The brush handle itself serves as the "plate guide" which tightly surrounds the bristles and moves forward along the length of the bristles to remove hair therefrom, similar to the Saltzinger type of customized hairbrush.

U.S. Pat. No. 3,886,617 issued to Labran apparently teaches a brush having a face plate through which bristles fit in guide holes. A plunger is connected to the face plate and extends through an intervening core member. Pressing the plunger again forces the face plate forward along the length of the bristles for hair removal.

U.S. Pat. No. 4,574,416 issued to Stewart apparently teaches a retractable brush in which the bristles are retracted inside the brush core. When retracted, the bristles are almost flush with the face plate of the core body.

The patents above demonstrate that those skilled in the art believe that hair is removed from the bristles of a brush by providing a face or guide plate through which the bristles are tightly fitted. Various lever means are then provided for moving the guide plate forwards along the length of the bristles almost until flush with the ends of the bristles. In the alternative, it is sometimes easier to think of the core member to which the bristles are attached as being moved away from the core, depending upon the brush design. Nevertheless, both designs basically comprise the elements of a face plate and a lever means for moving the face plate away from the brush. What is important to remember is that the single element common to all the designs is that they are each a custom designed brush. In other words, the face plate of each brush is not interchangeable with the core of any other brush without extensive modification. This is not only because of the unique face plate designs, but the lever means for moving the face plates all operate differently.

The only exception to the general rule above is found in the patents issued to Wire and Dombitsky. Wire teaches a pivoting face plate lever arm which fits loosely between rows of bristles. However, Wire is similar to the other designs in that the face plate is custom built and therefore only works in conjunction with a core member to which it is pivotally attachable.

Dombitsky teaches a design which is furthest from the teachings of all the other patents, but which also has drawbacks including the mesh-like material which the brush bristles must be capable of piercing. Some bristles are not suitable for this design and will be ruined if a mesh is forced down over them. Furthermore, if the mesh material is tight fitting, it is likely to be shredded when sliding it over the bristles because the mesh material is designed to be capable of being pierced by the bristles. If shredded, the mesh material is not likely to effectively remove hair. In the alternative, the mesh material will be so loose around the core in order to avoid tearing it when being put on, that it will likely interfere with use of the brush. A further disadvantage is that the mesh material is disposable and thus requires replacement often if the brush is to be kept clean.

Therefore it would be advantageous to overcome the limitation of having to customize the brush in order to remove hair so that the new system could be adaptable to virtually all brush shapes and bristle compositions. It would also be an advantage to have a reusable system which would not require replacement after only one use.

OBJECTS AND SUMMARY OF THE INVENTION

It is an object of the present invention to provide a method and apparatus which is adaptable for removing hair from virtually any hair brush.

It is another object of the invention to provide a method and apparatus for removing hair wherein said apparatus can be reused and cleaned.

It is yet another object of the invention to provide a method and apparatus for removing hair from a hair brush which can accommodate virtually any type of bristle composition.

It is still yet another object of the invention to provide a method and apparatus for removing hair from a hair brush which will not interfere with the normal use of the hair brush.

These and other objects of the present invention not mentioned but realizable from the method and apparatus described herein, are realized in a preferred embodiment of a hair brush hair removal system which in a preferred embodiment includes a hair brush attachment composed of numerous strands of a flexible and elastic material which is placed around a brush core. Various fastening means enable the attachment to be tightly wrapped and fastened around a core. When removed from the core, the strands bring with them the hair which has accumulated on the bristles. Hair is then easily removed from the strands, and then the attachment is again wrapped around the core.

In accordance with one aspect of the invention, the strands are replaced with a single long strand which goes back and forth between the fastening means. The result is two unattached ends of the strand at opposite ends of the fastening means. By pulling on either or both ends of the strand, the apparatus is adjustable to fit any shape of brush.

In accordance with another aspect, a scissor guide is fitted to the attachment so that hair can be easily cut to facilitate removal of hair from a round brush.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

When considering the embodiments of the present invention, it is important to remember that with the exception of one patent described above, all of the designs presented teach a customized hair brush with an integrally constructed hair removal means comprised of a guide or plate assembly which surrounds the bristles of a brush. The guide assembly is moved by some mechanism to extend out along the length of the bristles so as to dislodge the hair which has become entangled therein. By stopping just short of the ends of the bristles, the guide plate is supposed to have moved the hair from around the core member of the brush so that the hair can now easily be scraped and picked from the bristles.

The embodiments of the present invention are an abrupt departure from the teachings of the prior art, as well as from the exception to the prior art mentioned above. The present invention comprises a reusable hair brush attachment which is completely removable from a brush. Furthermore, the attachment in a preferred embodiment is suitable for use with nearly any shape brush, regardless of core dimensions, handle configuration and bristle patterns.

Figure 1:
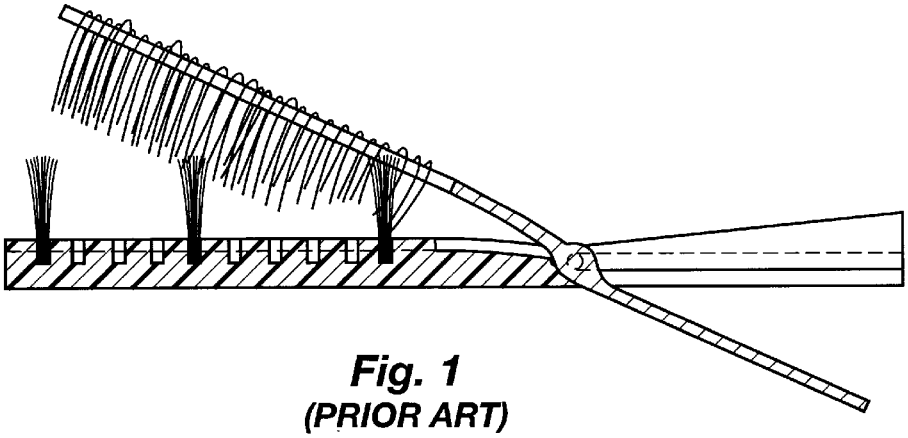
Fig. 1 (PRIOR ART)
FIG. 1 is an elevational profile view of a custom designed brush as taught by the prior art.
Figure 2:
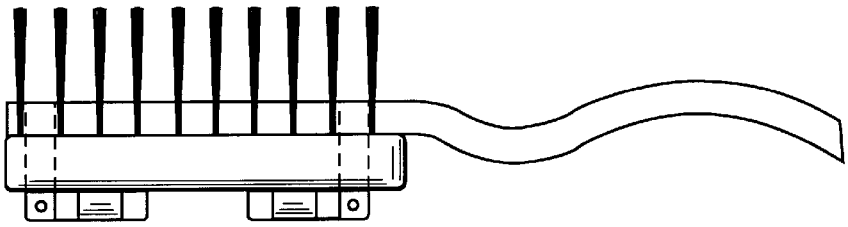
Fig. 2 (PRIOR ART)
FIG. 2 is an elevational profile view of a custom designed brush typical of the prior art.
Figure 3:
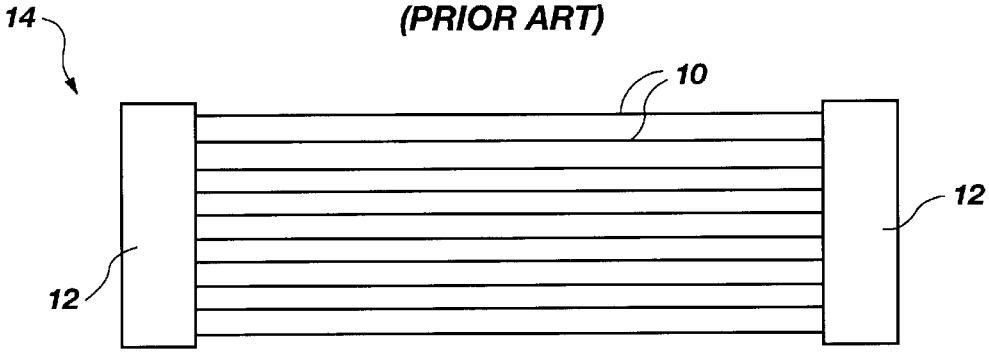
FIG. 3 is a profile view of the preferred embodiment for a hair attachment made in accordance with the principles of the present invention.

FIG. 3 is an illustration of the preferred embodiment constructed in accordance with the principles of the present invention. The figure shows the invention as it appears unrolled and laying flat. A plurality of strands 10 lie generally parallel to each other to form generally equidistant rows. At either end of the plurality of strands are fastening means 12 which lie generally perpendicular to the rows. The fastening means 12 are designed to couple together, and not to the brush to which the invention surrounds. Advantageously, no special modification is required on the brush with this design.

There are several features of the preferred embodiment of the present invention which also bear explanation. First, the fastening means, as will be explained, need only fasten to itself. Therefore, the shape or constraints of its design depend solely upon the coupling mechanism selected to coupled it to itself. FIG. 3 shows the fastening means 12 as relatively wide strips, but this width is arbitrary.

Another feature which is not readily apparent from the figure is the composition of the strands 10. In a preferred embodiment, the strands are made of a flexible, elastic material. In this way, the invention tightly covers the brush to which it is attached. Tight coverage advantageously prevents the attachment 14 from interfering with normal use of the brush. In other words, the strands 10 will not get caught in the hair which is being brushed. This feature is different from the Dombitsky patent which also avoids the concept of a fixed and customized guide plate. Dombitsky cannot, by its very design, be tight around a brush core member because it must be sufficiently loose to first be pulled over the bristles.

The invention illustrated in FIG. 3 is very simple, yet provides the substantial benefits over the prior art which have been mentioned. Specifically, several of the most important aspects are that the attachment 14 can be placed around almost any brush core member, it lies flush against the core member surface, can be attached to almost any generic brush and including the specialized brushes described in the prior art, it can be placed over bristles or tufts of bristles which are too fine to properly fit over a mesh material such as that described in Dombitsky, and can be washed and reused.

Figure 4A:
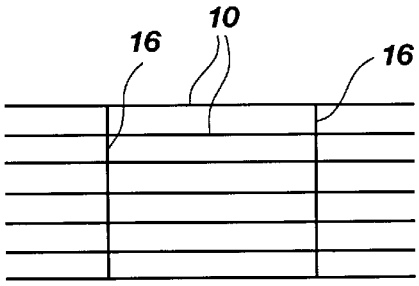
FIG. 4A is a modification to the structure of the strands of FIG. 3.

FIG. 4A illustrates a different aspect of the invention. In an alternative embodiment, it can be desirable to provide some support for removing hair to the rows of strands 10 by placing at least one other strand 16 perpendicular to the direction of the rows of the plurality of strands 10, but in the plane of the rows. The at least one other strand 16 is then coupled to each strand 10 where they intersect. This arrangement provides stability to the design, especially useful when removing the attachment from a brush and pulling the hair with it. Furthermore, the perpendicular strands 16 form an additional orientation which the attachment 14 will use to remove more hair caught in the bristles. The perpendicular strands 16 can be placed in any arrangement as desired.

Figure 4B:
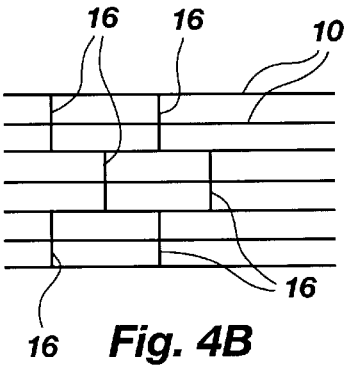
FIG. 4B is an alternative embodiment to the design of FIG. 4A.

FIG. 4B illustrates in another alternative embodiment that the strands 16 running perpendicular to the rows of strands 10 do not have to be continuous from the top row to the bottom row of strands 10. As shown, for example, the perpendicularly running strands 16 are shown to couple fewer of the rows of strands 10, and are also shown as alternating (not lined up) with other perpendicular strands 16. This can be useful, for example, when making the present invention for use on a brush with unusual bristle patterns.

Figure 5:
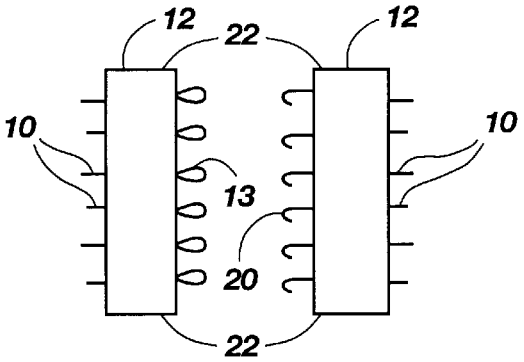
FIG. 5 is close-up of the detail of a first embodiment of a fastening means.

FIG. 5 illustrates a first aspect of the fastening means 12. In this particular embodiment, the fastening means 12 is formed of complementary hooks 20 and loops 18 formed in the fastening means 12. It should be recognized that if the fastening means 12 is formed of a rigid material, or there is a rigid material within the fastening means 12, then a hook and loop on the outer edges 22 of the fastening means 12 will provide sufficient tension across the fastening means 12 length to securely hold the attachment means 14 in place.

Figure 6:
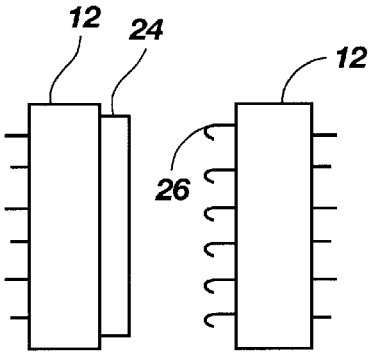
FIG. 6 is close-up of the detail of a second embodiment of a fastening means.

FIG. 6 illustrates an alternative embodiment of a coupling mechanism for the fastening means 12. Instead of a plurality of small loops 18 as in FIG. 5, a single long hoop 24 is provided. The hoop 24 must be of a rigid material. Bowing at the center of the loop would render the attachment 14 loose around the brush. The hoop 24 could, for example, be comprised of metal or stiff plastic that could withstand the strain of being attached. Again, it should also be obvious that this design only requires a single hook 26 at either end of the fastening means 12.

Figure 7:
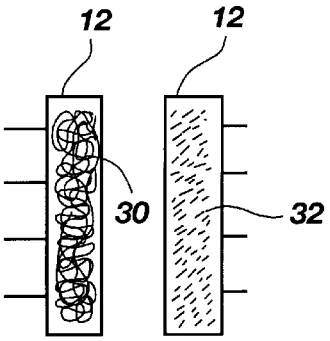
FIG. 7 is close-up of the detail of a third embodiment of a fastening means.

FIG. 7 illustrates another embodiment of the present invention for the coupling mechanism. As shown, one of the fastening means 12 has one half of a VELCRO, a hook and loop fastener attaching surface. The attachable surface 30 is generally a looped thread-like material which is easily snagged because it presents a convoluted surface. An opposing face 32 of the fastening means 12 is comprised of the attaching surface 32 which is comprised of a plurality of tiny hooks which snag the attachable surface 30.

Figure 8:
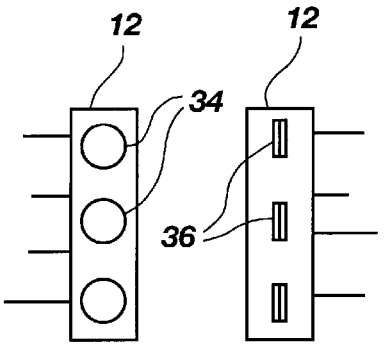
FIG. 8 is close-up of the detail of a fourth embodiment of a fastening means.

FIG. 8 provides another coupling mechanism for the fastening means 12. The coupling mechanism comprises a plurality of buttons 34 on one face of the fastening means 12. On the opposing face of the fastening means 12 are a plurality of button holes 36 for receiving the buttons 34.

Figure 9:
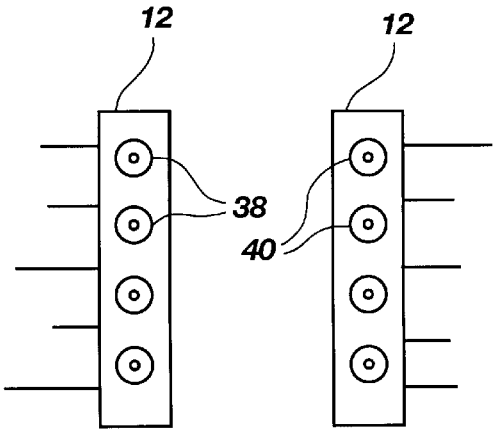
FIG. 9 is close-up of the detail of a fifth embodiment of a fastening means.

FIG. 9 provides still another coupling mechanism for the fastening means 12. The coupling mechanism comprises a plurality of snap projections 38 on one face of the fastening means 12. On the opposing face of the fastening means 12 are a plurality of snap receptacles 40 for receiving the snap projections 38.

It should be clear from the numerous figures provided above that the coupling mechanism can be any appropriate means for providing consistent tension along the length of the fastening means 12. In this way, none of the strands 10 of the attachment 14 will become loose and entangled in the hair of user. Preferably, the coupling mechanism is simple to use, sturdy so as not to break from repeated use, and reusable.

Figure 10A:
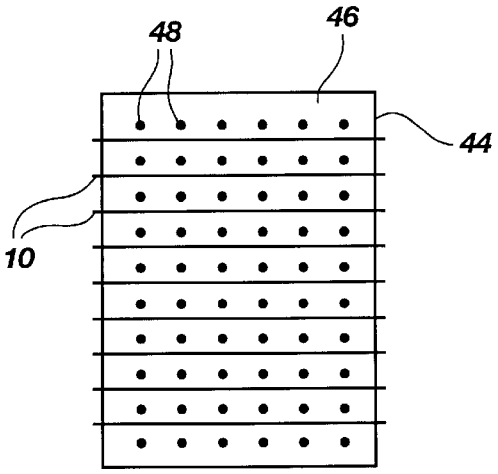
FIG. 10A is a detailed diagram of the invention placed around a brush core member.

FIG. 10A is the first illustration of the present invention shown attached to a core member 44 of a brush having a front face 46 (see FIG. 10B) with a plurality of bristles 48 extending outwardly therefrom and generally orthogonal to the plane of the front face 46. The important features to observe are that the strands 10 fit between rows of bristles 48. Another feature is that the bristles 48 could just as easily be tufts formed of many bristles originating from a single hole in the brush face 46.

Unlike Dombitsky which would have a hard time working on a brush having many fine bristles instead of generally singular and spaced apart bristles 48 as those shown, the present invention could just as easily have strands 10 worked to fit down between a plurality of fine bristles 48. The core member 44 could also be attached to a handle so as to appear as a more conventional and typical brush. However, a handle was purposely left off the drawings to emphasize that the handle plays virtually no role in the function of the attachment 14.

Figure 10B:
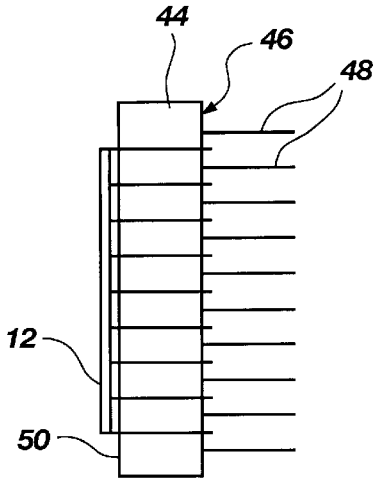
FIG. 10B is a profile view of FIG. 10A.

FIG. 10B shows a profile view of the brush core member 44 of FIG. 10A. The core member 44 in this case is generally rectangular in its dimensions, but could just as easily have a different shape.

Figure 10C:
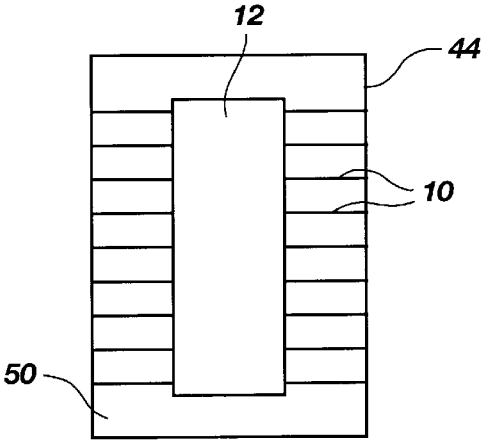
FIG. 10C is a view of the back of the core member of FIG. 10A.

FIG. 10C shows the back face 50 of the core member 44. The specific coupling mechanism used to join the fastening means 12 has not been shown, but can be assumed to be one of the designs illustrated in FIGS. 5 through 9.

Another feature which may not be evident from the figures provided is that the invention generally forms a cylinder cut along its length and having open ends.

Figure 11A:
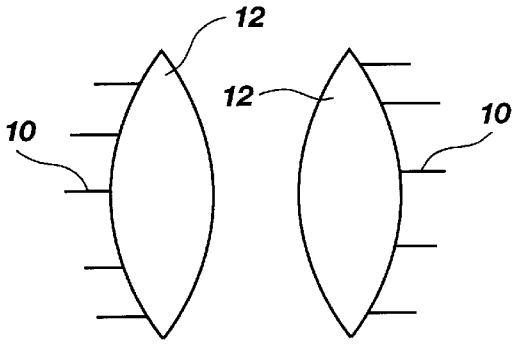
FIG. 11A is an alternative shape for the fastening means 12.
Figure 11B:
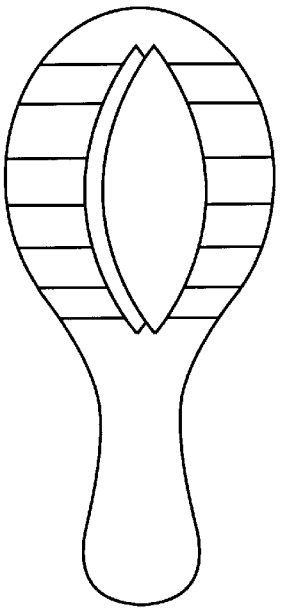
FIG. 11B shows the shape of a brush best suited for the fastening means of FIG. 11A, with the attachment wrapped around the brush.

FIG. 11A is an alternative design of the shape of the fastening means 12 of the present invention. If the fastening means of FIG. 10A were used, the strands 10 at the ends of the fastening means 12 might be loose if the strands were of uniform length as shown in FIG. 3, and wrapped a body of non-uniform width. By using the fastening means of FIG. 11A on the brush shown in FIG. 11B, the strands 10 could be made of a non-uniform length. Specifically, the strands on the ends of the fastening means 12 are made shorter than the strands 10 near the center of the length of the fastening means 12.

Figure 12A:
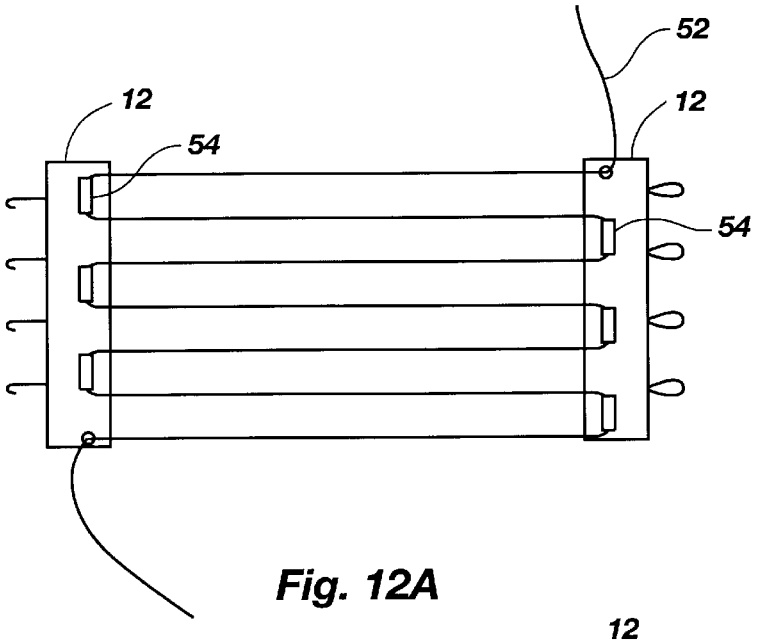
FIG. 12A is a first embodiment of the continuous strand design.

FIG. 12A illustrates one possible method of getting around the problem of having a very irregularly shaped brush core member. The alternative design replaces the plurality of strands 10 with a single continuous strand 52. The advantage of the continuous strand 52 is the ability to adjust the tension on any single length of the strand 52 around the core member as the strand 52 is wrapped around the core member. This is accomplished by providing a plurality of alternating projections or hollow guides on the fastening means. If the attachment has hollow guides as shown, the attachment is disposed on a brush in much the same way as the preferred embodiment. After the strand 52 is fitted between the bristles, the tension on the strand 52 is adjusted by slowly tightening the strand 52 beginning at one end and proceeding along the strand length until reaching the opposite end.

Figure 12B:
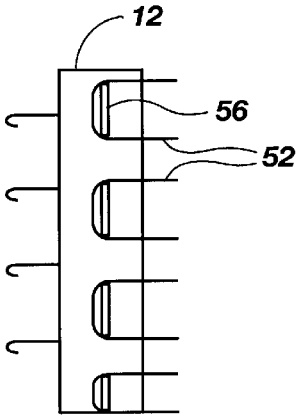
FIG. 12B is alternative embodiment of the continuous strand embodiment.

Alternatively, the hollow guides might be nothing more than projections 56 extending outward from the surface of the fastening means 12 as shown in FIG. 12B. Placing the attachment on the core member then comprises the steps of 1) firmly holding the fastening means 12 against the back of the core member, 2) securing the strand 52 to a first end of the fastening means 12, 3) guiding the strand across the brush face until reaching the fastening means, 4) looping the strand around a next alternating projection, 5) repeating steps 3) and 4) until the strand covers the brush face, and 6) securing the strand 52 to a second end of the fastening means 12.

Figure 12C:
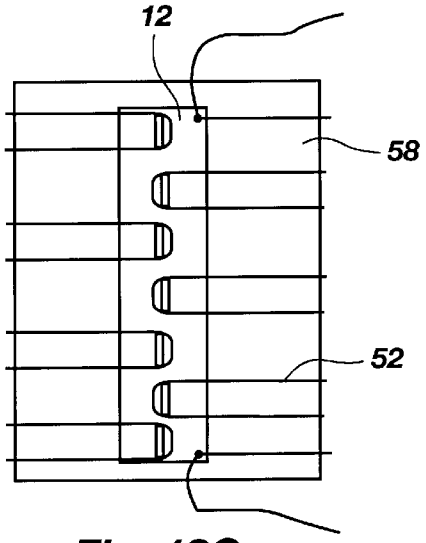
FIG. 12C is another alternative embodiment of the continuous strand embodiment.

An alternative embodiment described in FIG. 12C shows the fastening means 12 as a single element and not two elements as in all the previous embodiments. The continuous strand 52 is wrapped around the core member 58 exactly as described above for FIG. 12B, but the fastening means 12 is easier to handle because it is not in two separate pieces.

Figure 13A:
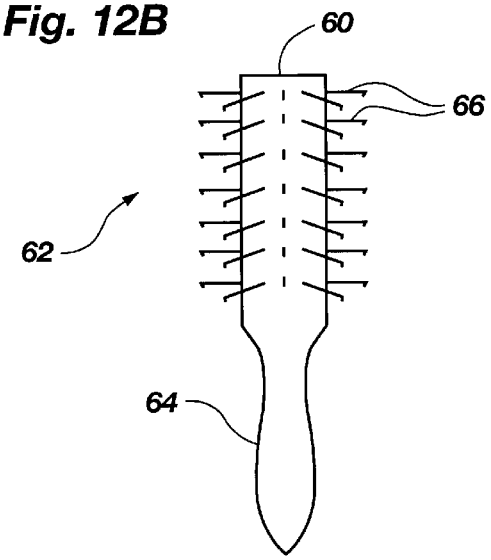
FIG. 13A shows a round brush without an attachment.
Figure 13B:
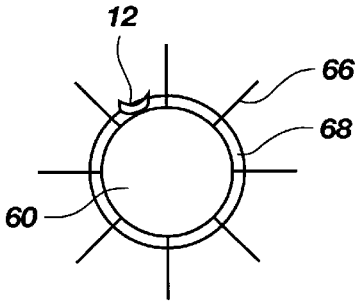
FIG. 13B is a top view of the brush with the attachment coupled thereto.

FIG. 13A shows a core member 60 of a round brush 62 having a handle 64. The bristles 66 extend outward generally orthogonally from the core member 60, and without an attachment. FIG. 13B shows a top view of the brush 62 looking down on the core member 60, but with the attachment 68 surrounding the core member 60. The fastening means 12 has a shape which is different from previous embodiments in that it is rigid so it can be curved away from the core member 60. The shape of the fastening means is curved so as to act as a depression in which scissors are used to cut along hair which is covering the fastening means 12 which might prevent it from being removed from the core member 60. This is a problem not encountered in previous embodiments because hair cannot be deposited over the fastening means 12. It should be noted that the coupling mechanism of the fastening means can be any appropriate design previously described.

Figure 14A:
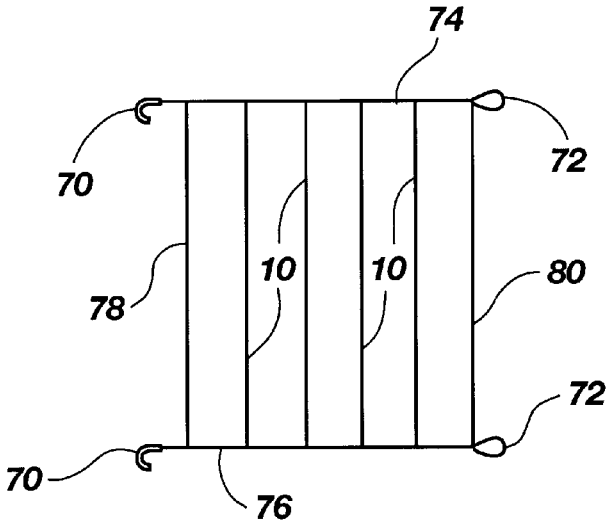
FIG. 14A shows an alternative embodiment for attachment to a round brush.
Figure 14B:
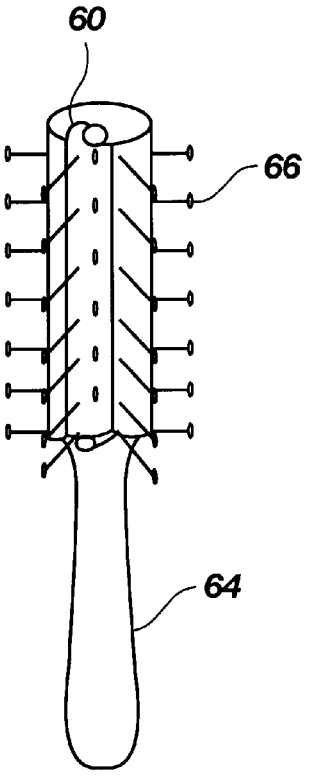
FIG. 14B shows the embodiment of FIG. 14A coupled to a round brush.

FIG. 14A provides an alternative embodiment to the embodiment of FIGS. 13A and 13B. This embodiment does not have the scissor guide 12 incorporated into the fastening means. This illustrations shows a simple hook 70 and hoop 72 design at the top 74 and the bottom 76 of the invention, with the strands 10 still running vertically between the top 74 and bottom 76. To enable the scissors to cut the hair, the strands 78 and 80 which are at the ends of the invention next to the hooks 70 and hoops 72 are spaced further apart so that the scissors can safely move vertically through the bristles without fear of cutting the strands 78 and 80 as shown in FIG. 14B. The hooks 70 and hoops 72 are then unlatched and proceeding from either end 78 or 80, the invention is peeled away from the brush 60 with the hair. It should be remembered that any of the means for fastening might be used in this embodiment as well. However, hooks, snaps and button designs are probably going to be easier to use as opposed to strips of VELCRO, a hook and loop fastener, which require a larger surface area of attachment.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. In a hair brush having a lengthwise core member wherein a plurality of bristles protrude therefrom, a hair brush hair removal system including a reusable attachment wherein the system ensnares hair which is entangled in said brush for removal therefrom, said system comprising:

a plurality of elastic strands having generally uniform length, arranged generally in parallel and spaced apart, said strands lying against the core member and fitting between the bristles;

a first fastening device that is coupled to a first end of the plurality of elastic strands, said first fastening device being comprised of a rigid material;

a second fastening device that is coupled to a second end of the plurality of elastic strands, wherein the first fastening device is coupled to the second fastening device to thereby secure the plurality of elastic strands to the hair brush;

wherein hair is removed from the plurality of bristles by disengaging the first fastening device from the second fastening device to thereby enable the plurality of elastic strands to be pulled away from the hair brush.

2. The hair brush hair removal system as defined in claim 1 wherein the first fastening device that is coupled to a first end of the plurality of elastic strands has a depression along a length thereof.

3. The hair brush hair removal system as defined in claim 1 wherein the second fastening device that is coupled to a second end of the plurality of elastic strands is comprised of a rigid material.

* * * * *